United States Patent [19]

Hellmers

[11] Patent Number: 4,697,957

[45] Date of Patent: Oct. 6, 1987

[54] MARINE PILE PROTECTIVE SYSTEM

[76] Inventor: Emil D. Hellmers, 81 Rivo Alto Canal, Long Beach, Calif. 90803

[21] Appl. No.: 86,059

[22] Filed: Oct. 18, 1979

Related U.S. Application Data

[63] Continuation of Ser. No. 929,104, Jul. 31, 1978, abandoned.

[51] Int. Cl.[4] ..... E02D 5/60

[52] U.S. Cl. ..... 405/216; 405/212; 405/219

[58] Field of Search ..... 405/211, 216, 212, 219; 52/170, 727

[56] References Cited

U.S. PATENT DOCUMENTS

| | | | |
|---|---|---|---|
| 3,181,300 | 5/1965 | Plummer | 405/216 |
| 3,999,399 | 12/1976 | Maurer | 405/216 X |
| 4,023,374 | 5/1977 | Colbert | 405/216 |
| 4,068,483 | 1/1978 | Papworth | 405/216 |

FOREIGN PATENT DOCUMENTS

| | | | |
|---|---|---|---|
| 828431 | 12/1969 | Canada | 405/216 |

*Primary Examiner*—David H. Corbin

*Attorney, Agent, or Firm*—Leonard Tachner

[57] ABSTRACT

A preformed thick walled split tube of extruded hexene-ethylene copolymer of ultra high molecular weight forms a sheath about timber piles. The sheath is sealed to form a stagnant space toxic to marine borers. The sheath is tough, resilient and of high tensile strength sufficient to protect the pile from destructive mechanical forces and abrasion.

1 Claim, 3 Drawing Figures

MARINE PILE PROTECTIVE SYSTEM

This is a continuation, of application Ser. No. 929,104, filed Jul. 31, 1978, now abandoned.

BACKGROUND OF THE INVENTION

1. Field of Invention

This invention relates to wood pilings used for wharfs, piers or other marine structures, and particularly to systems for protecting the pilings from deterioration due to infestation and/or mechanical abrasion.

2. Discussion of the Prior Art

Marine borers have been the cause of great damage to marine pilings. Not uncommonly, creosote treated pilings have been branded unserviceable after six or seven years, particularly in warmer regions. The cause is a relatively new species of Limnoria that penetrates the wood, and then tunnels along the grain. Once the surface is penetrated, other marine borers, notably Toredo, mount a second wave attack.

A system for protecting marine piling from such marine animal destruction has been pioneered by Osmose, of Madison, Wis. This system, promoted under the trademark PILE-GARD, involves the use of thin flexible PVC plastic sheeting 0.030 inches thick, wrapped closely about the exterior of the piling from the mud line to above the intertidal zone. Seals create a closed envelope that soon stagnates to become permantely oxygen deficient. The entrapped borers die. Since none penetrates from the outside, the piling is thereby protected from further destruction and attack.

There are significant problems with the sheet plastic wrap system. Peripheral fender piles are exposed to impact by boats and floating debris. A partial solution is to nail vertical protective strips to the peripheral fender piles. The protective strips are themselves subject to abrasion; their fasteners deteriorate or loosen. Even interior piles are abraded by floating debris. All piles are subjects for vandalism. Polyvinyl chloride is not stable in the presence of creostote. Creosote embrittles the sheet material to the point where it ultimately cracks away. It has been proposed to utilize a second polyethylene sheet interposed between the creosoted pile and the other polyvinyl chloride sheet. The polyethlene sheet protects the outer sheet from cresote while the outer sheet protects the inner sheet from destructive ultra violet radiation.

A dual sheet arrangement still may require protective vertical bars or straps. Three elements must then be used for protection of a pile. Installation of a thin polyethylene sheet must be very carefully done. The polyethylene sheet is very easily ripped or torn. Elaborate surface preparation of the pile may be required. Even minor random folds in the polyethylene produce localized stress and ultimate rupture.

OBJECTIVES

The primary object of the present invention is to provide a durable, easily installed, one piece system for protecting a pile from marine infestation as well as from destructive mechanical forces and abrasion.

SUMMARY OF THE INVENTION

In order to accomplish the foregoing objectives, I provide a preformed relatively thick walled spilt tube made of extruded hexene-ethylene copolymer, a polyethylene having ultra-high molecular weight and nearly neutral density. Such material is commerically available and sold under trademarks DRISCOPIPE[1]7600 and NIPAK.[2] Such materials are extremely tough, temperature stable and resistant to stress cracking. This material is stable in a salt water environment and does not rust or corrode electrolytically or galvanically. It does not host the growth of bacteria, algae or fungi.

[1]Registered Trademark of Drilling Specialties Co.
[2]Registered Trademark of Nipak, Inc.

Extruded tubes with wall thickness of between 0.16 and 0.20 inches have elastic memory. Ten to fourteen foot lengths of such tubes are snapped over the pile from beneath the mud line to above the extreme high tide line. Polyurethane foam seals are installed at the edges. Ratchet tools tightly compress the tubes about the pile while aluminum nails are placed to secure it about the pile.

BRIEF DESCRIPTION OF THE DRAWINGS

A detailed description of the invention will be made with reference to the accompanying drawings wherein like numerals designate corresponding parts in the several figures. These drawings are to scale.

DETAILED DESCRIPTION OF PREFERRED EMBODIMENT

The following detailed description is of the best presently contemplated mode of carrying out the invention. This description is not to be taken in a limiting sense, but is made merely for the purposes of illustrating the general principles of the invention since the scope of the invention is best defined by the appended claims.

Figure 1:
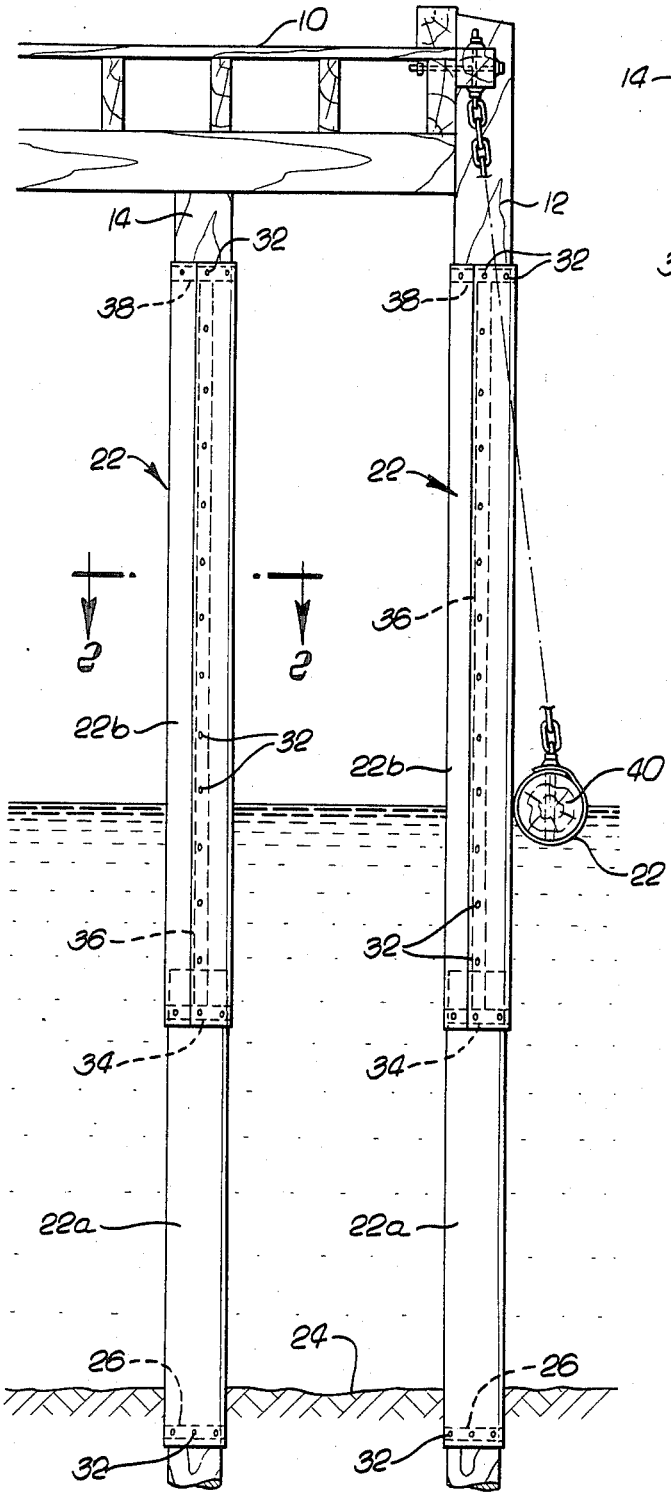
FIG. 1 is a vertical sectional view of a typical wharf structure with both fender and interior piles as well as camel logs sheathed in accordance with the present invention.
Figure 2:
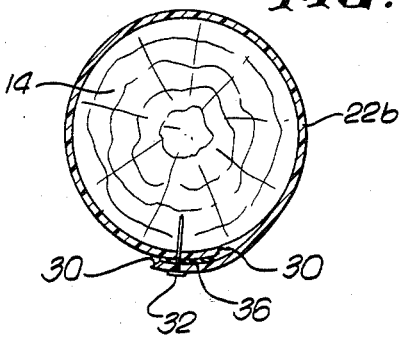
FIG. 2 is an enlarged transverse cross sectional view taken along a plane corresponding to line 2—2 of FIG. 1.
Figure 3:
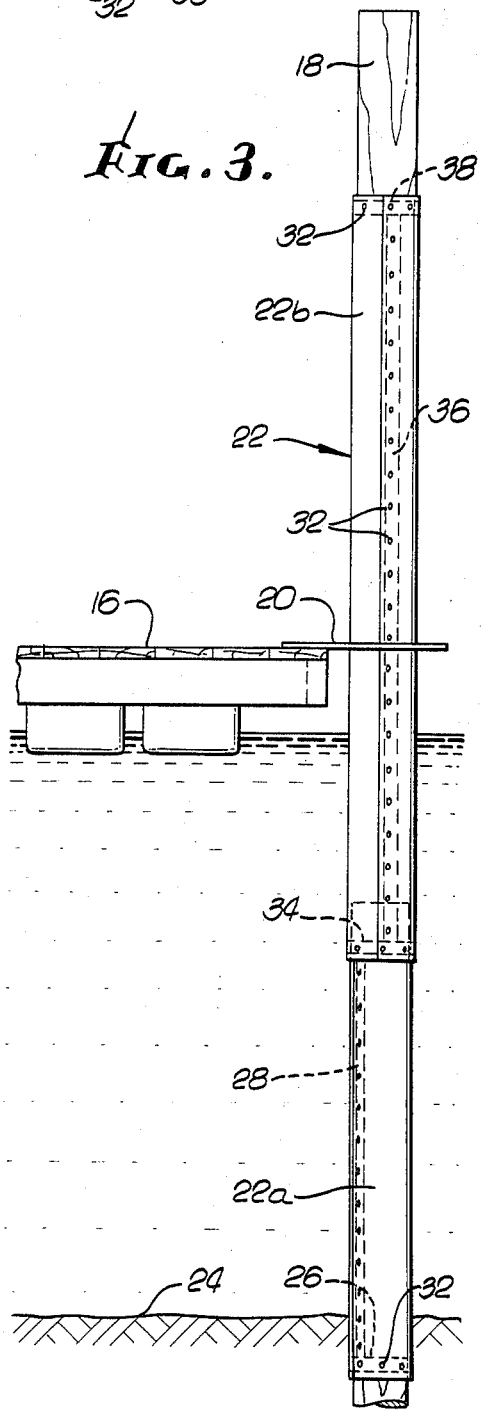
FIG. 3 is a vertical sectional view of a typical float structure with guide piles sheathed in accordance with the present invention.

The invention presently to be described is applicable wherever piles are subjected to abrasion and/or marine infestations. A typical wharf structure is shown in FIG. 1. It includes a platform 10 supported over tidal waters by peripheral fender piles 12 and interior piles 14. In FIG. 3, there is illustrated a typical float structure 16 cooperable with guide piles, one of which is shown at 18. A guide attachment 20 slides up and down along the guide pile 18 to secure the float.

The piles, 12, 14 and 18 are each sheathed by protective tubes 22. The tubes 22 are made of ultra-high density hexene-ethylene copolymer, having a high molecular weight. Suitable materials available in tubular form are sold under the trademarks NIPAK and DRISCOPIPE 7600.

NIPAK is reported to have a cell classification of PE 335433C by ASTM D-3350. NIPAK and DRISCOPIPE 7600 are suggested for a wide variety of industrial and agricultural uses, available in various diameters. The pipe is made as an extrusion. The preferred wall thickness is about 0.16 inches to 0.20 inches. The material is tough, flexible and resilient.

A section **22*a* of split tube is installed at the bottom of the pile, preferably from a point excavated below the mud or bottom line 24. The pipe is installed by forceably spreading one end apart until it can snap about the pile, and then progressively spreading adjoining portions of the split tube until the entire tube is positioned about the pile. A foam polyurethane strip 26 is positioned beneath the lower terminus of the tube to provide a seal. A similar seal strip 28(FIG. 3**) is positioned between the longitudinally overlapped edges of the tube.

The nominal diameter of the tube 22 is slightly greater than the nominal diameter of the piling that it is to encompass. The longitudinal cut 30 is made at an angle of about 45° so that the edges mutually guide themselves to an overlapped relationship. Otherwise the edges abut and lock together. Nylon webbing material encircling the tube 22 can be cranked or ratcheted in order to draw the tube tightly into position while aluminum alloy nails 32 fasten the tube in place at the bottom, along the overlapped edges and at the top.

A second section **22*b* is installed above the first section 22*a* with an overlap at the bottom. Preferably, the second section extends at least two feet beneath the extreme low tide line to a point three feet above the extreme high tide line. The upper section 22*b* is provided with a seal strip 34 at its lower end. A longitudinal seal strip 36 and a top seal strip 38** are also provided.

The companion tubes **22*a* and 22*b* cooperate to define a space to which neither ambient air nor ambient water are exposed. The space is thus deprived of oxygen. The trapped marine borers are exterminated, and no marine borers enter through the tubes 22. The tubes 22** provide very adequate protection from floating debris and water craft.

Carbon black incorporated in the base resin of the tube material prevents damage from exposure to direct sunlight. No loss of properties should be experienced in twenty years.

In FIG. 1, there is illustrated a tethered camel log 40 sheathed with a tube 22 to provide durablilty.

Intending to claim all novel, useful and unobvious features shown or described, I make the following claims:

1. The combination of a marine log and a single layer protective covering therefor comprising:

(a) a sheath made as an extruded tube of semi-rigid ultra-high density hexene-ethylene copolymer having characteristics of high tensile strength, resilience and toughness sufficient to withstand mechanical impact and abrasion;

(b) said sheath having a nominal diameter prior to installation that exceeds the diameter of the marine log, and having a wall thickness of at least about 0.16 inches;

(c) said sheath being longitudinally split with edges overlapped with at least one side of the split being bevelled to cam the edges out of abutting relationship and into overlapped relationship upon the imposition of a closing circumferential force; and (d) fasteners engaging along said overlapped edges and holding said edges overlapped and said sheath in place to provide a space for trapping water between the log and the sheath, the space between the sheath and the log being otherwise free.

* * * * *